United States Patent [19]

Simon

[11] Patent Number: 4,818,027

[45] Date of Patent: Apr. 4, 1989

[54] ROUND SHAFT BIT

[75] Inventor: Peter Simon, Rickenbach, Fed. Rep. of Germany

[73] Assignee: Betek Bergbau-und Hartmetalltechnik Karl-Heinz Simon GmbH & Co. KG, Aichhladen, Fed. Rep. of Germany

[21] Appl. No.: 145,218

[22] Filed: Jan. 19, 1988

[30] Foreign Application Priority Data

Jan. 23, 1987 [DE] Fed. Rep. of Germany ..... 3701905

[51] Int. Cl.[4] ..... E21C 35/18

[52] U.S. Cl. ..... 299/92; 299/86

[58] Field of Search ..... 299/79, 86, 91, 92, 299/93; 29/229, 451, 453

[56] References Cited

U.S. PATENT DOCUMENTS

| | | | |
|---|---|---|---|
| 1,475,136 | 11/1923 | Olson | 101/29 |
| 2,988,405 | 6/1961 | Scheldorf | 29/453 X |
| 3,512,838 | 5/1970 | Kniff | 299/92 X |
| 4,603,911 | 8/1986 | Hindmarsh et al. | 299/86 X |
| 4,660,890 | 4/1987 | Mills | 299/86 X |
| 4,688,856 | 8/1987 | Elfgen | 299/79 |

FOREIGN PATENT DOCUMENTS

| | | | |
|---|---|---|---|
| 3233123 | 3/1984 | Fed. Rep. of Germany | 299/79 |

*Primary Examiner*—Stephen J. Novosad
*Assistant Examiner*—David J. Bagnell
*Attorney, Agent, or Firm*—Thomas W. Speckman

[57] ABSTRACT

The invention relates to a round shaft bit with a bit head and a bit shaft, in which the bit shaft has a circumferential groove with a longitudinally slotted clamping sleeve positioned therein, and in which the bit shaft with the clamping sleeve placed under tension can be axially fixed in a bore of a bit holder whereby the bit shaft remains freely rotatable in the clamping sleeve. The insertion of the round shaft bit into the bore of a bit holder is, in accordance with the invention, significantly simplified and facilitated by the clamping sleeve being held in a clamping position by means of a holding element, in which the external diameter of the clamping sleeve is equal to or smaller than the diameter of the bore of the bit holder and that upon inserting the bit shaft with the clamping sleeve into the bore of the bit holder, the holding element moved onto an area of the bit shaft lying outside the clamping sleeve so that the clamping sleeve tensions against the interior of the bore holding the round shaft bit in axial position within the bore.

15 Claims, 1 Drawing Sheet

ROUND SHAFT BIT

BACKGROUND OF THE INVENTION

1. Field of the Invention

This invention relates to a round shaft bit with a bit head and a bit shaft, in which the bit shaft has a circumferential groove with a longitudinally slotted clamping sleeve positioned therein, and in which the bit shaft can be axially fixed in a bore of a bit holder with the clamping sleeve placed under tension while the bit shaft remains freely rotatable in the clamping sleeve.

2. Description of the Prior Art

A round shaft bit is known from the U.S. Pat. No. 1,475,136. In this, the clamping sleeve extends over the most significant portion of the axial dimension of the bit shaft, in order to obtain the greatest possible support and clamping surface for the clamping sleeve in the bore of the bit holder. Such types of long clamping sleeves additionally bring the advantage that a sufficiently great holding force is produced between the clamping sleeve and the bore of the bit holder. Since the holding collar is narrow on the free end of the bit shaft, and the clamping sleeve, when inserting the bit shaft with the clamping sleeve into the bore of the bit holder, must be pressed together with great force, considerable difficulties arise when inserting the round shaft bit of this type into a bore of the bit holder. Numerous installation devices which are specific to this problem have been provided.

SUMMARY OF THE INVENTION

It is an object of the present invention to provide a round shaft bit of the previously stated type, in which the insertion into a bore of a bit holder is considerably facilitated, despite the long clamping sleeve with high tensioning forces.

This object is achieved in accordance with the invention through the fact that the clamping sleeve is held in a clamping position by means of a holding element, in which the external diameter of the clamping sleeve is equal to or less than the diameter of the bore of the bit holder, and that, when inserting the bit shaft with the clamping sleeve into the bore of the bit holder, the holding element can be adjusted into an area of the bit shaft lying outside the clamping sleeve.

In the round shaft bit provided with the holding element, the clamping sleeve is held tightly enough that the bit shaft with the clamping sleeve can be pushed into the bore of the bit holder even manually over a great portion of its axial dimension, until, for example, the holding element abuts on the insertion side of the bit holder. The round shaft bit can be driven to the shoulder of the bit head adjacent the bit holder by means of a hammer blow. By this means, the holding element is slid from the clamping sleeve, and reaches an area of the bit shaft free from the clamping sleeve, so that the clamping sleeve, with the clamping force particular to it, can be tensed in the bore of the bit holder, whereby the tension force correspondingly increases with increasing drive-in depth.

One particularly simple construction is characterized in that the holding element is constructed as a holding ring or holding disk, which encloses the clamping sleeve, and that the internal diameter of the holding ring or the holding disk is equal to or smaller than the diameter of the bore of the bit holder. Such type of holding element is a simple part which can be produced easily and inexpensively.

In order for the axial dimension of the bit shaft to be able to be utilized optimally for the clamping sleeve, one further development provides that a circumferential groove of the bit shaft extends up to a distance from the bit head, which is equal to or greater than the diameter of the round material or the thickness of the holding disk used for the holding ring.

The bit head of the round shaft can rest on the frontal side of the bit holder which is turned towards it, if the embodiment is so constructed that the bore of the bit holder has a groove on the insertion side, which, with the bit shaft with clamping sleeve inserted into the bore, accommodates the holding element formed as a holding ring.

The holding element of the round shaft bit can be used as a support disk on the frontal side of the bit holder through the fact that the holding element formed as a holding disk, in the case of a bit shaft inserted into the bore of the bit holder, with the clamping sleeve between the bit head and the wall surrounding the bore, is positioned on the insertion side of the bit holder.

In this it is provided that the holding disk is comprised of securely locking material, and has an external diameter which is equal to or greater than the maximum external diameter of the bit head, so that the holding disk in the area projecting over the bit head serves as a locking protection for the bit holder.

In accordance with one preferred embodiment, it is provided that the bit head is formed running into a collar adjacent to the bit shaft; that a hard metal insert is inserted into the bit point turned away from the bit shaft; and that the clamping sleeve extends essentially over a major portion of the axial length of the bit shaft.

BRIEF DESCRIPTION OF THE DRAWING

The invention will now be further illustrated by means of examples of execution depicted in the drawing wherein.

DESCRIPTION OF PREFERRED EMBODIMENTS

Figure 1:
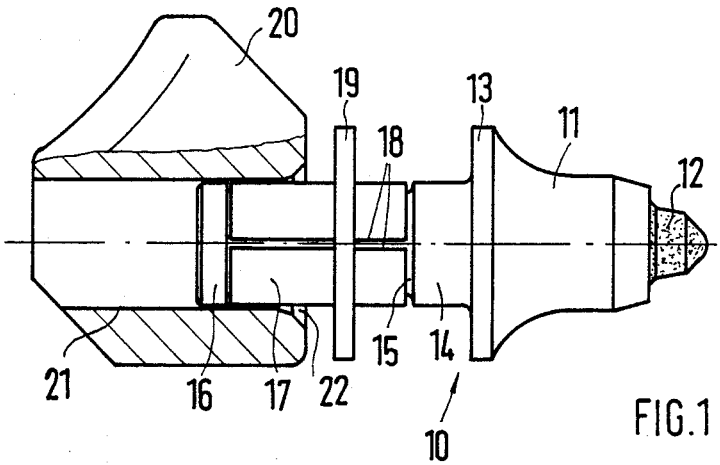
FIG. 1 is a side view of a round shaft bit with a holding element constructed as a holding disk, in the insertion position, in which the bit shaft with the clamping sleeve is inserted into the bore of a bit holder shown in section without means of tension.

In the embodiment shown in FIG. 1, bit shaft (14) projects from bit head (11) on round shaft bit (10). The transition of the bit head is thus constructed as collar (13), which forms the greatest external diameter of bit head (11). The hard metal insert (12) is inserted into the bit tip in the known manner. The clamping sleeve (17) provided with the longitudinal slot (18) rests in circumferential groove (15) on bit shaft (14). Clamping sleeve (17) extends over the greatest portion of the axial dimension of bit shaft (14), so that collar (16) on the free end of bit shaft (14), and the area free from the clamping sleeve (17) up to the bit head (11), are very narrow. A holding disk is slid onto clamping sleeve (17) as holding element (19). The disk forces the clamping sleeve (17) to such an extent that its external diameter is equal to or smaller than the diameter of bore (21) in bit holder (20). Longitudinal slot (18) is wide enough so that clamping sleeve (17) can be pressed together far enough that its internal wall lies on the base of circumferential groove (15) in bit shaft (14). Since bore (21) of bit holder (20) is provided with an insertion expansion (22) the bit shaft (14) of round shaft bit (10) can be easily inserted into bore (21). This insertion process can be carried out manually, until holding element (19) strikes the frontal side of the bit holder (20). With increased application of force, for example, by means of a blow from a hammer, the round shaft bit (10) can be driven far enough into bore (21) so that collar (13) of bit head (11), by means of the holding element (19), faces against the frontal side of bit holder (20). In this manner, holding element (19) formed as a holding disk is moved from clamping sleeve (17) down onto the free area of the bit shaft (14) between clamping sleeve (17) and the bit head (11), so that it releases clamping sleeve (17). Clamping sleeve (17) can now be tensed with the tensing force specific to it, in the bore (21) of bit holder (20), since it would accommodate, in the unstressed condition, an external diameter which is greater than the diameter of bore (21) of bit holder (20). The difference between both diameter values determines the tensing force of clamping sleeve (17), and thereby the force with which the round shaft bit (10) is held in bore (21) of bit holder (20).

In the embodiment in accordance with FIG. 1, the external diameter of the holding disk corresponds to the maximum external diameter of bit head (11) in the area of collar (13). The holding disk thereby serves as a protective disk for bit holder (20), since it cushions the impact forces acting on round shaft bit (10). If the external diameter of the holding disk is expanded over the maximum external diameter of the bit head (11), then the entire frontal side of the bit holder (20) is protected against wear, if the holding disk is made of wear-resistant material.

Figure 2:
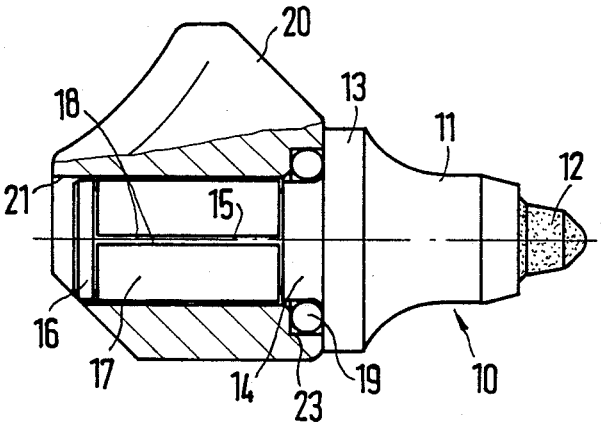
FIG. 2 is a side view of a round shaft bit with a holding element constructed as a holding ring, in the operating position, with the clamping sleeve tensed in the bore of the bit holder, shown in section, and the bit shaft which can be freely rotated within the clamping sleeve.

The embodiment in accordance with FIG. 2 is distinguished from the embodiment in accordance with FIG. 1 only by the form of the holding element (19). FIG. 2 shows round shaft bit (10) in the operating position. In this embodiment, collar (13) of bit head (11) abuts on the frontal side of bit holder (20). Holding element (19) is constructed as a holding ring of a round material. Bore (21) of bit holder (20) has, in the frontal side facing bit head (11), groove (23) which accommodates the holding ring forced into it from clamping sleeve (17). The area of bit shaft (14) free from clamping sleeve (17), between clamping sleeve (17) and bit head (11), must thus have at least a width which corresponds to the diameter of the round material used for the holding ring. The construction of clamping sleeve (17) and the holding ring in relation to their various diameters takes place analogously to the embodiment in accordance with FIG. 1, so that clamping sleeve (17) prestressed with the holding ring can easily be manually inserted into bore (21) of bit holder (20), and that, with clamping sleeve (17) released from the holding ring, a sufficiently great tensing force between clamping sleeve (17) and bore (21) of bit holder (20) is attained. The bit shaft (14) remains on the other hand freely rotatable in clamping sleeve (17), since, in the tensing position, the internal diameter of clamping sleeve (17) is greater than the diameter of bit shaft (14) in the area of circumferential groove (15).

I claim:

1. A round shaft bit for insertion into the bore of bit holder, said round shaft bit comprising: a bit head (11) and bit shaft (14), said bit shaft (14) having a circumferential groove (15), a clamping sleeve (17) supported in said groove (15), said clamping sleeve (17) having a longitudinal slot (18) and a variable external diameter, a holding element (19) fitting over said clamping sleeve (17) holding said clamping sleeve in a clamping position in which position the variable external diameter of said clamping sleeve (17) is not greater than the diameter of a bore (21) of a bit holder (20) into which said bit shaft (14) is inserted, said holding element (19) being moveable onto an area of bit shaft (14) beyond said clamping sleeve (17) when said bit shaft (14) is fully inserted into said bore (21) placing said clamping sleeve (17) in force relation against said bore (21) axially fixing said bit (10) in said bore (21) of said bit holder (20), said bit shaft (14) remaining freely rotatable within said clamping sleeve (17).

2. A round shaft bit in accordance with claim 1, wherein said holding element (19) is constructed as a holding ring which encloses the clamping sleeve (17), the internal diameter of said holding ring being not greater than the diameter of said bore (21).

3. A round shaft bit in accordance with claim 2, wherein said bit shaft (14) has a narrow collar (16) at its terminal end and a narrow bit shaft portion adjacent said bit head (11) defining said circumferential groove (15) therebetween.

4. A round shaft bit in accordance with claim 3 wherein said circumferential groove (15) of said bit shaft (14) is spaced a distance from said bit head (11) which is not less than the thickness of said holding ring.

5. A round shaft bit in accordance with claim 4, wherein said bore (21) of said bit holder (20) has a groove (23) on the insertion face, said groove (23) and said bit shaft (14) with said clamping sleeve (17) inserted into said bore (21), accommodates said holding element (19) constructed as a holding ring.

6. A round shaft bit in accordance with claim 5, wherein said bit head (11) has a collar (13) adjacent said bit shaft (14); a hard metal insert (12) inserted into the bit point facing away from said bit shaft (14); and said clamping sleeve (17) extends over a major portion of the axial length of said bit shaft (14).

7. A round shaft bit in accordance with claim 1, wherein said holding element (19) is constructed as a holding disk which encloses the clamping sleeve (17), the internal diameter of said holding disk being not greater than the diameter of said bore (21).

8. A round shaft bit in accordance with claim 7, wherein said bit shaft (14) has a narrow collar (16) at its terminal end and a narrow bit shaft portion adjacent said bit head (11) defining said circumferential groove (15) therebetween.

9. A round shaft bit in accordance with claim 7, wherein said holding element (19) is constructed as a holding disk when said bit shaft (14) is inserted into said bore (21) of said bit holder (20) and is positioned over said clamping sleeve (17) between said bit head (11) and the wall at the end of said bore (21) on the insertion side of said bit holder (20).

10. A round shaft bit in accordance with claim 7, wherein said holding disk is comprised of securely locking material and has an external diameter which is not less than the maximum external diameter of said bit head (11).

11. A round shaft bit in accordance with claim 7, wherein said bit head (11) has a collar (13) adjacent said bit shaft (14); a hard metal insert (12) inserted into the bit point facing away from said bit shaft (14);, and said clamping sleeve (17) extends over a major portion of the axial length of said bit shaft (14)

12. A round shaft bit in accordance with claim 1 wherein s id circumferential groove (15) of said bit shaft (14) is spaced a distance from said bit head (11) which is not less than the thickness of said holding ring.

13. A round shaft bit in accordance with claim 1 wherein the open end of said bore (21) has an expansion area (22) on the insertion face of said bit holder (20) for facilitating insertion of said bit shaft (14) into said bore (21).

14. A round shaft bit in accordance with claim 1, wherein said bit head (11) has a collar (13) adjacent said bit shaft (14); a hard metal insert (12) inserted into the bit point facing away from said bit shaft (14); and said clamping sleeve (17) extends over a major portion of the axial length of said bit shaft (14).

15. A round shaft bit in accordance with claim 1, wherein said bit shaft (14) has a narrow collar (16) at its terminal end and a narrow bit shaft portion adjacent said bit head (11) defining said circumferential groove (15) therebetween.

* * * * *